US010424854B2

(12) United States Patent
Muller et al.

(10) Patent No.: US 10,424,854 B2
(45) Date of Patent: Sep. 24, 2019

(54) HIGH-POWER ELECTRICAL CONTACT

(71) Applicant: LEUKERT GMBH, Kaufbeuren-Neugablonz (DE)

(72) Inventors: Matthias Muller, Bad Worishofen (DE); Rudi Kolb, Fussen-Hopfen (DE)

(73) Assignee: LEUKERT GMBH, Kaufbeuren-Neugablonz (DE)

( * ) Notice: Subject to any disclaimer, the term of this patent is extended or adjusted under 35 U.S.C. 154(b) by 0 days.

(21) Appl. No.: 16/313,083

(22) PCT Filed: Jun. 16, 2017

(86) PCT No.: PCT/EP2017/064831
§ 371 (c)(1),
(2) Date: Dec. 24, 2018

(87) PCT Pub. No.: WO2018/007129
PCT Pub. Date: Jan. 11, 2018

(65) Prior Publication Data

US 2019/0229444 A1 Jul. 25, 2019

(30) Foreign Application Priority Data

Jul. 6, 2016 (DE) ..... 10 2016 112 434

(51) Int. Cl.
*H01R 11/12* (2006.01)
*H01R 12/70* (2011.01)
(Continued)

(52) U.S. Cl.
CPC ..... *H01R 11/12* (2013.01); *H01R 12/7088* (2013.01); *H01R 13/111* (2013.01); *H01R 13/40* (2013.01); *H01R 43/16* (2013.01)

(58) Field of Classification Search
CPC ..... H01R 13/111; H01R 11/12; H01R 11/283
See application file for complete search history.

(56) References Cited

U.S. PATENT DOCUMENTS 2,399,957 A * 5/1946 Tinnerman ..... F16B 37/041 336/136
2,399,958 A * 5/1946 Tinnerman ..... F16B 37/041 336/136

(Continued)

FOREIGN PATENT DOCUMENTS

DE 102006025078 A1 12/2007

OTHER PUBLICATIONS

International Search Report for corresponding PCT application No. PCT/ep2017/064831, dated Sep. 13, 2017.

*Primary Examiner* — Ross N Gushi
(74) *Attorney, Agent, or Firm* — Notaro, Michalos & Zaccaria P.C.

(57) ABSTRACT

The invention relates to a device for power contacting having a contact-pin receptacle and at least one electrical connector where the contact-pin receptacle is integrally formed from two partial contacts that are arranged one over the other at a distance from each other and can be moved relative to each other. Each partial contact has an opening with contact arms protruding into the opening, and the two openings are arranged coaxial to each other. The contact arms of one opening are bent toward the contact arms of the other opening in such a way that the contact arms mesh with each other.

10 Claims, 4 Drawing Sheets

Figure 1:
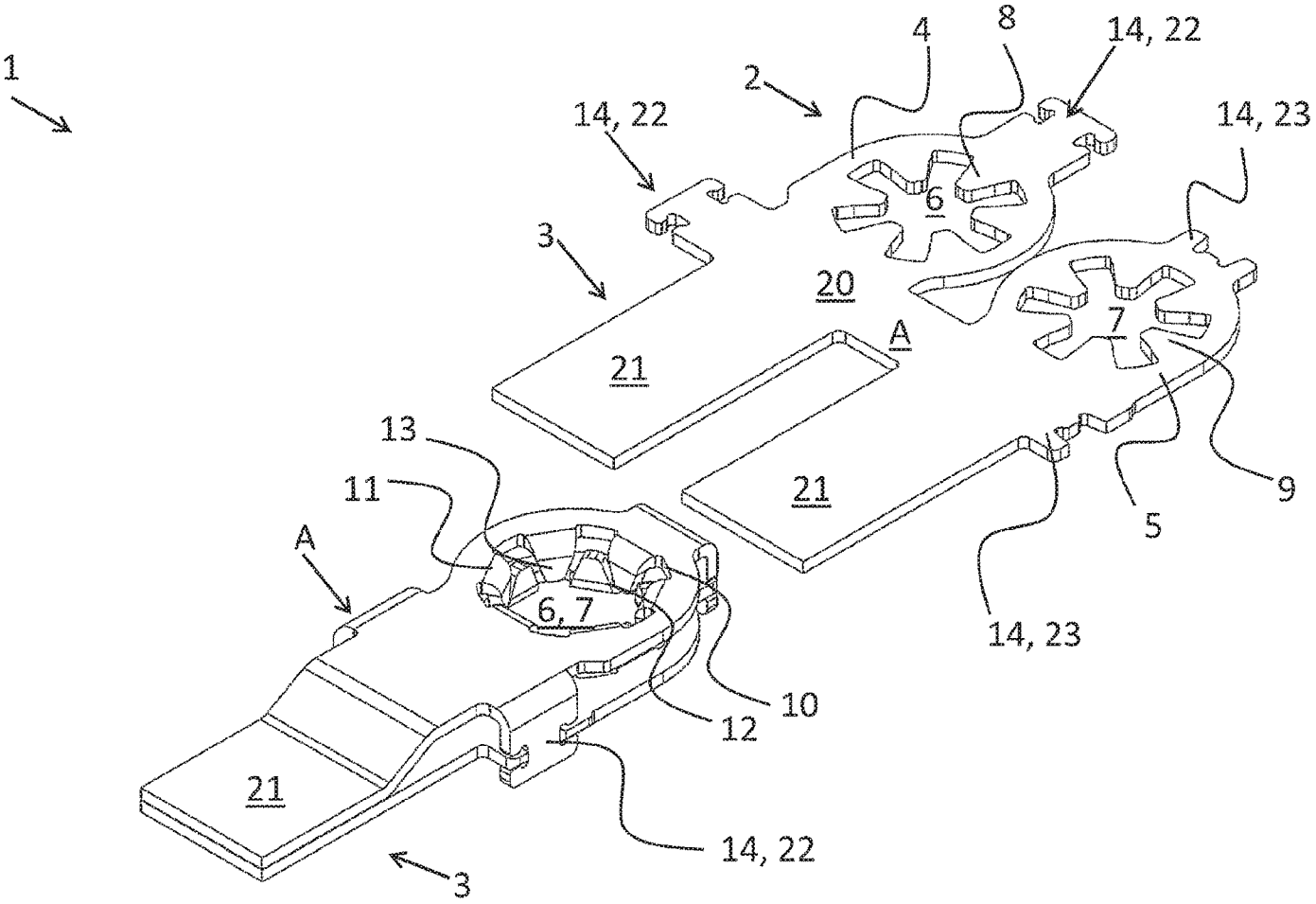

(51) Int. Cl.

| | |
|---|---|
| ***H01R 13/40*** | (2006.01) |
| ***H01R 43/16*** | (2006.01) |
| ***H01R 13/11*** | (2006.01) |

(56) References Cited

U.S. PATENT DOCUMENTS 2,404,176 A * 7/1946 Huelster ..... H01R 13/20 24/674
3,285,313 A 11/1966 Blakesley
3,340,494 A * 9/1967 Gutshall ..... H01R 4/26 411/149
3,569,919 A * 3/1971 Daddona, Jr. ..... H01R 13/20 439/848
3,796,124 A * 3/1974 Crosa ..... E04D 3/3605 411/521
3,980,388 A * 9/1976 Nailor, III ..... H01R 11/22 439/752
5,183,419 A * 2/1993 Dewar ..... H01R 11/286 439/388
5,302,142 A * 4/1994 Tabata ..... H01R 11/283 439/762
5,302,143 A * 4/1994 Inoue ..... H01R 11/283 439/762
5,445,907 A * 8/1995 Ito ..... H01R 11/283 429/178
5,492,780 A * 2/1996 Okada ..... H01R 11/283 429/121
5,584,730 A * 12/1996 Tabata ..... H01R 11/282 439/762
5,707,192 A * 1/1998 Vortriede ..... F16B 37/041 411/175
5,733,152 A * 3/1998 Freitag ..... H01R 11/281 439/762
5,897,281 A * 4/1999 Haga ..... F16B 37/0842 411/521
6,520,812 B1 * 2/2003 Machado ..... H01R 11/282 439/855
6,607,409 B2 * 8/2003 Machado ..... H01R 11/282 439/855
6,676,455 B2 * 1/2004 Machado ..... H01R 11/282 439/855
6,817,908 B2 * 11/2004 Freitag ..... H01R 11/285 439/763
7,234,979 B2 * 6/2007 Fujii ..... H01R 11/283 439/754
8,210,786 B2 * 7/2012 Okada ..... F16B 37/02 411/437
8,317,549 B2 * 11/2012 Falchetti ..... H01R 11/283 439/762
8,496,503 B2 * 7/2013 Lamoureux ..... H01R 13/111 439/860
8,556,661 B2 * 10/2013 Kwon ..... H01M 2/105 439/627
9,206,807 B2 * 12/2015 Li ..... F16F 1/324
9,252,414 B2 * 2/2016 Kwon ..... H01M 2/105
9,263,810 B2 * 2/2016 Noh ..... H01R 11/283
9,746,018 B2 * 8/2017 Williams ..... F16B 37/02
9,774,110 B1 * 9/2017 Ritchie ..... H01R 4/308
9,784,298 B2 * 10/2017 Weatherl ..... A01G 25/092
9,915,281 B2 * 3/2018 Weatherl ..... A01G 25/092
9,979,104 B2 * 5/2018 Falchetti ..... H01R 11/24
10,050,358 B2 * 8/2018 Muller ..... H01R 12/523
2001/0039145 A1 11/2001 Schaefer et al.
2016/0126530 A1 * 5/2016 Kato ..... H01M 2/305 429/121
2018/0226627 A1 * 8/2018 Shiohama ..... H01M 2/305
2019/0131726 A1 * 5/2019 Krass ..... H01R 11/283

* cited by examiner

HIGH-POWER ELECTRICAL CONTACT

The present invention relates to a high-power electrical contact.

In the field of power contacting in particular interconnected circuit boards, stacks of circuit boards, busbars or other components conducting increased currents, currents of from more than 100 A up to 600 A or more often occur, wherein such circuit boards or busbars are used for example in the field of electric motors, batteries, accumulators or generally in the field of connecting power loads and sources of electrical energy. Especially in the field of electromobility, very high charging currents are needed and require correspondingly dimensioned power contacts that are suitable for everyday use.

The known devices for power contacting in particular circuit boards or stacks of circuit boards between, for example, accumulators and power loads regularly comprise contact pins that pass through the circuit boards in the operating state, wherein the contact pins are in each case guided in a holder of the circuit board. Said holder is often provided with a resilient ring or more generally with resilient contacts for securely contacting the contact pin in a permanent manner. Contact pins of this kind are usually made of metal and are round in cross section.

In components in which the circuit boards or stacks of circuit boards move relative to one another in the operating state, for example because of different degrees of heating, securely contacting the contact pin to the component is not ensured in every operating state. For example, the circuit boards can move in such a way that the resilient contacts of the holders do not fully abut the contact pin.

It is therefore the object of the invention to provide a power contact that permanently ensures high-quality contacting even when the contacted components move relative to the contact pin, and that allows a secure transmission of high currents even in the case of small structural dimensions.

This object is achieved in that the device for power contacting according to the invention comprises a contact pin holder and at least one electrical connection, wherein the contact pin holder is integrally formed from two partial contacts which are arranged so as to be spaced apart, one on top of the other, and which can move relative to one another, wherein each partial contact comprises an opening having contact arms which project into the opening, wherein the two openings are coaxial with one another, wherein the contact arms of one opening are bent towards the contact arms of the other opening so as to mesh with one another. The movement, caused by thermal or mechanical load, of one contact pin, for example of a battery, in relation to the device according to the invention is advantageously compensated for by the partial contacts that move relative to one another and, as seen along the contact pin, are furthermore axially mutually spaced such that they contact a larger region of the contact pin. Because of the arms that, according to the invention, are bent so as to mesh with another, there is always a sufficient surface for electrons to overlap. The integral design of the two partial contacts establishes a secure mechanical connection between the two partial contacts and allows the device to be produced in a cost-effective manner, since assembly steps can be dispensed with.

The invention is designed such that the openings are round or angular. In this case, a round opening is preferred because the vast majority of contact pins are cylindrical and a round opening is therefore most suitable for contacting. However, since there are also angular contact pins, in particular those with a square, hexagonal or octagonal cross section, correspondingly shaped openings in the partial contacts are also in accordance with the invention.

According to the invention, it is advantageous for the contact arms, starting from an opening edge, to firstly comprise a portion that extends radially, followed by a portion that extends axially, and in particular to comprise a camber and/or imprint in the latter. In principle, the inner edge of the opening would be sufficient for contacting the contact pin; however, arms extending in this way are particularly suitable for applying a resilient force, and therefore bearing against or being pressed against the wall of the contact pin with a certain force. As a result, secure contacting is made possible even when the contact pin, due to mechanical or thermal influences, passes through the opening in the partial contact in a skewed manner.

In one development of the invention, the two partial contacts are interconnected by means of at least one further connecting device, preferably by means of two connecting devices, in particular two connecting devices of a similar design. As a result, even though the movement of the two partial contacts relative to one another is made more difficult, the device as a whole gains stability without the movement thereof becoming too restricted in the process.

One particularly advantageous design is for the electrical connection to be integral with the contact pin holder. As a result, the high-power electrical contact according to the invention is advantageously produced from a single part, in particular stamped and bent from a continuous processed metal strip.

In one development of the invention, the electrical connection is a component which can be connected to the contact pin holder and comprises a connecting portion for this purpose. Although this alternative design is more complex to carry out in terms of production and requires the provision of connecting portions on the electrical contact and the contact pin holder, it does offer the significant advantage of constructing the two parts of the invention individually so as to be adapted to the relevant body to be contacted.

If the electrical connection comprises a connection end, in particular designed as a blade, contact button, crimp, solder end or rivet, then the electrical connection can be custom-made according to its intended use, without the contact pin holder having to be changed.

In one development of the invention, the connecting portion of the electrical connection is trident-shaped, the two outer arms of the trident being bent so as to be spaced in alignment above and below the middle arm. This multilayered design allows a large part of the surface of the electrical contact to be used for conducting current.

In one development of the invention, the distance from the upper to the middle arm and from the lower to the middle arm corresponds to a material thickness of the contact element, and the thickness of the middle arm corresponds to a distance between the two partial contacts. This advantageously represents a particularly secure and durable connection between the two parts of the device for power contacting according to the invention.

Finally, the invention further provides for the respective connection surfaces of the partial contacts and the electrical connection to comprise corresponding gratings. A grating of this kind further increases the available surface area for conducting current, but above all it leads to an improved form-fitting connection between the two parts of the invention.

The invention is described by way of example in a preferred embodiment with reference to the drawings, wherein further advantageous details can be found in the drawings.

Functionally identical parts are provided with the same reference signs.

Figure 2A:
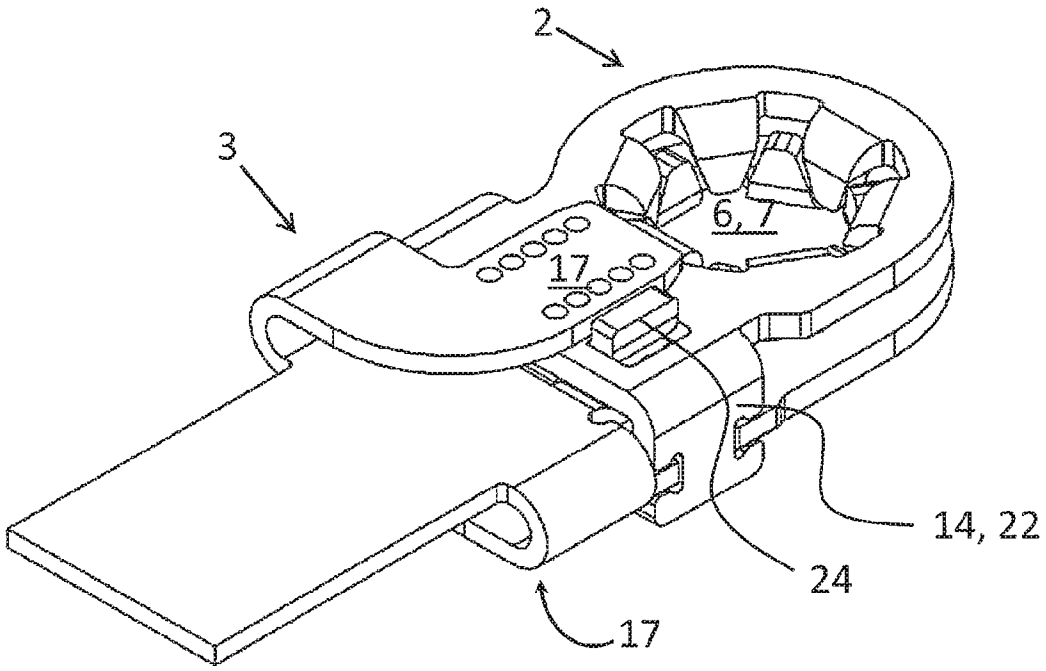
Figure 2B:
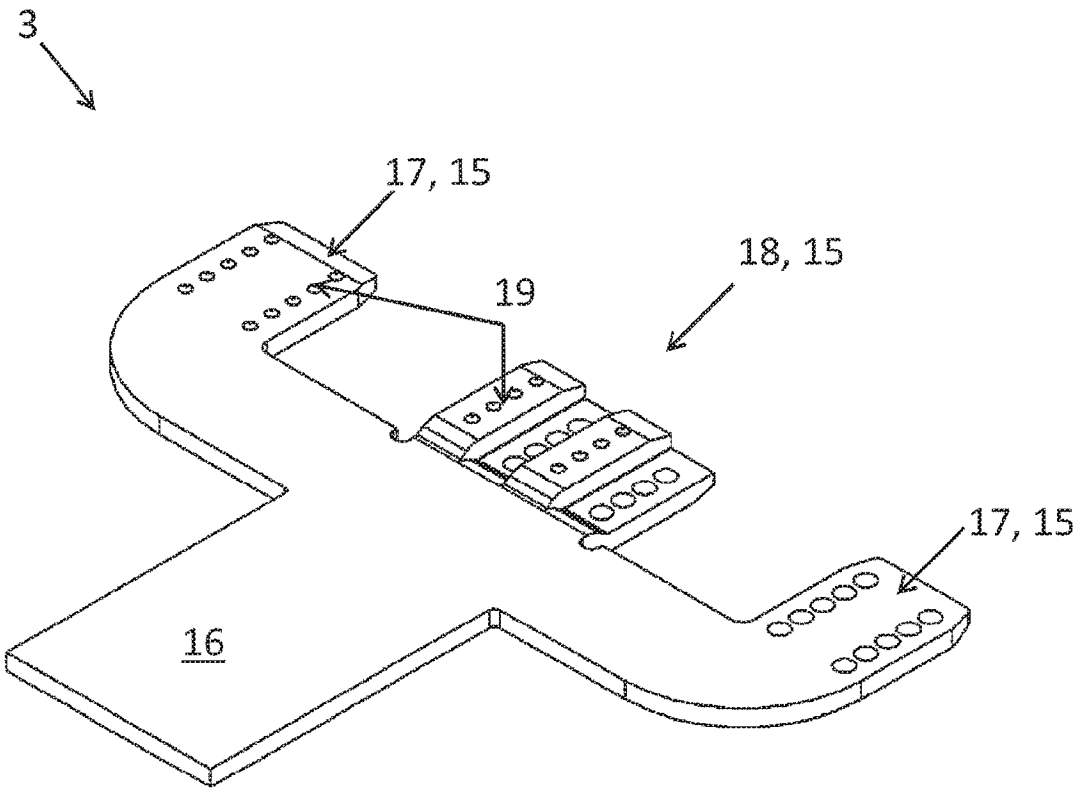

Detailed drawings are provided, in which:

FIG. 1 schematically shows a first embodiment before and after folding,

FIGS. 2*a* and 2*b* schematically show a second embodiment, and

Figure 3:
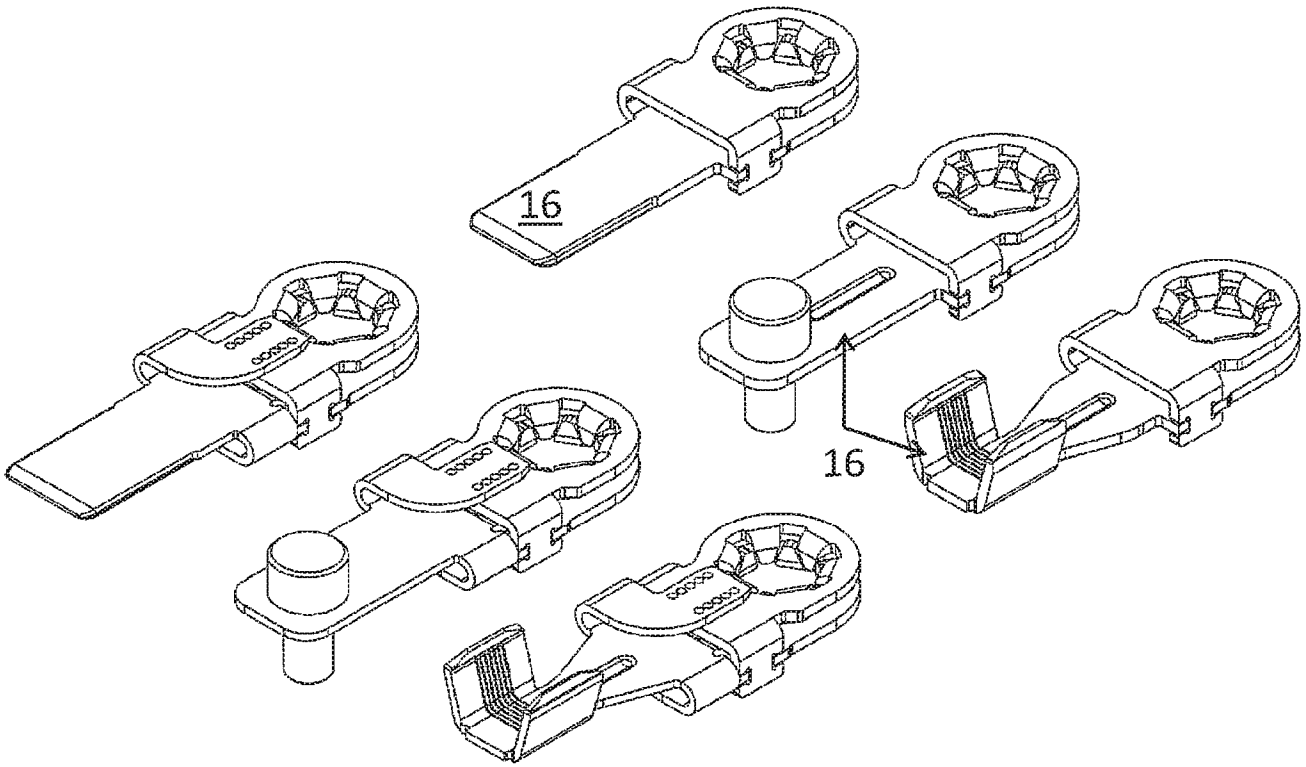

FIG. 3 schematically shows further embodiments.

The illustration at the top of FIG. 1 shows a device 1 according to the invention before folding, comprising an electrical connection 3 and a contact pin holder 2 that comprises two integrally formed partial contacts 4 and 5. The partial contacts 4, 5, for their part, each comprise an opening 6, 7 and are interconnected at a base 20. The electrical contact 3 is also fixed to the base 20 and consists in this case of two partial blades 21. The entire power contact is therefore produced in one piece. Arms 8, 9 can be seen clearly in the openings 6, 7, and two connecting devices 14 of a similar type, each consisting of a latch arm 22 and a catch 23, can also be seen. The length of the latch arm 22 determines in turn the distance between the two partial contacts 4, 5. The bottom part of FIG. 1 represents the ready-to-use state of the embodiment according to the invention, already folded. It can be seen that the two openings 6, 7 are coaxial with one another and that the arms 8, 9 of a partial contact 4, 5, starting from an opening edge 10, firstly comprise a portion 11 that extends radially, followed by a portion 12 that extends axially, the arms of one partial contact meshing with those of the other partial contact. An imprint 13 can also be seen on the latter portion 12, such that a contact pin passing through the openings 6, 7 is contacted by means of surface contact and not just by means of linear contact. It can also be seen that the distance between the two partial contacts 4, 5 is determined primarily by the length of the latch arm 22, which corresponds to a distance A in the region of the base 20. The two partial contacts are therefore interconnected twice in the region of the base 20 and once in the region most remote from the opening 6, 7. This triple connection results in a stable high-power contact of which the two partial contacts are nevertheless variable in position with respect to one another within certain limits. Finally, it can also be seen that the two partial blades 21 can be bent towards one another, each partial blade 21 being bendable towards the other, or both being bendable towards one another to the same degree.

FIG. 2*a* shows a second embodiment of the invention, in a ready-to-use state, formed in two parts from the contact pin holder 2 and the electrical connection 3. FIG. 2*b* shows the electrical connection 3 in the pre-folded state, before it has been joined to the contact pin holder 2. The connection is trident-shaped, comprising two outer arms 17 and a middle arm 18, each arm bearing a grating 19. The connection end 16 is in turn designed as a blade. FIG. 2*a* shows the bending of the electrical connection 3, which leads to three layers spaced apart, one on top of the other, between which layers the material of the base 20 of the contact pin holder 2 is clamped. The middle arm 18 is therefore clamped in the contact pin holder 2, while one layer of the contact pin holder 2 is clamped between the upper arm 17 and the middle arm, and one layer of said holder is clamped between the lower arm and the middle arm. This sandwich connection allows optimal surface utilisation for transmitting current and at the same time provides a large surface area for radiating heat. Two stops 24 can also be seen, which laterally support the upper and lower arms 17 and which are formed by means of stamping and bending in the region of the base 20.

Finally, the top row in FIG. 3 shows a plurality of integral embodiments of the invention, each having a differently designed connection end 16 of the electrical connection 3 and having the same contact pin holder 2. The connection ends 16 of the electrical connection 3 are represented herein, from left to right, as a blade, a crimp and a plug.

The bottom row in FIG. 3. shows a plurality of two-part embodiments of the invention, each having a differently designed connection end 16 of the electrical connection 3 corresponding to the abovementioned sequence. The contact pin holder 2 is identical to those in the above row. It can be seen that the stops 24 are optional and thus do not need to be present on every two-part embodiment. The lack of the second connecting device 14 in the region of the opening 6, 7 shows that said device is also optional.

The high-power contact according to the invention is thus adaptable to many intended uses and it allows, by virtue of the two partial contacts being able to move relative to one another and by virtue of the resilient design of the contact arms and the axial extension thereof, secure contact to a contact pin even under harsh conditions of use. The high-power contact, in particular in the two-part form thereof and due to the sandwich construction thereof, permits high currents to be securely conducted, even in the case of small overall dimensions.

LIST OF REFERENCE SIGNS

1 Device for power contacting
2 Contact pin holder
3 Electrical connection
4 Partial Contact
5 Partial Contact
6 Opening
7 Opening
8 Contact arm
9 Contact arm
10 Opening edge
11 Radial portion
12 Axial portion
13 Imprint
14 Connecting device
15 Connecting portion
16 Connection end
17 Outer arm
18 Middle arm
19 Gratings
20 Base
21 Partial blade
22 Latch arm
23 Catch
24 Stop

The invention claimed is:

1. Device for power contacting (1), comprising a contact pin holder (2) and at least one electrical connection (3), wherein the contact pin holder (2) is integrally formed from two partial contacts (4, 5) which are arranged so as to be spaced apart, one on top of the other, and which can move relative to one another, wherein each partial contact (4, 5) comprises an opening (6, 7) having contact arms (8, 9) which project into the opening (6, 7), wherein the two openings (6, 7) are coaxial with one another, wherein the contact arms (8, 9) of one opening (6, 7) are bent towards the contact arms (8, 9) of the other opening so as to mesh with one another, wherein the contact arms (8, 9), starting from an opening edge (10), firstly comprise a portion (11) that extends radially, wherein the portion (11) that extends radially is followed by a portion (12) that extends axially characterized in that the partial contacts (4, 5) are moveable relative to each other, wherein the partial contacts (4, 5) are interconnected at a base (20) with a distance A to each other, wherein the two partial contacts (4, 5) are interconnected by means of at least one further connecting device (14) and wherein a length of a latch arm (22) of the connecting device (14) corresponds to the distance A.

2. Device for power contacting (1) according to claim 1, characterised in that the openings (6, 7) are round or angular.

3. Device for power contacting (1) according to claim 1, characterised in that the contact arms (8, 9) comprise a camber and/or imprint in the latter.

4. Device for power contacting (1) according to claim 1, characterised in that the two partial contacts (4, 5) are interconnected by means of two connecting devices (14), in particular two connecting devices (14) of a similar design.

5. Device for power contacting (1) according to claim 1, characterised in that the electrical connection (3) is integral with the contact pin holder (2).

6. Device for power contacting (1) according to claim 1, characterised in that the electrical connection (3) is a component which can be connected to the contact pin holder (2) and comprises a connecting portion (15) for this purpose.

7. Device for power contacting (1) according to claim 1, characterised in that the electrical connection (3) comprises a connection end (16), in particular designed as a blade, contact button, crimp, solder end or rivet.

8. Device for power contacting (1) according to claim 6, characterised in that the connecting portion (15) of the electrical connection (3) is trident-shaped, the two outer arms (17) of the trident being bent so as to be spaced in alignment above and below the middle arm (18).

9. Device for power contacting (1) according to claim 8, characterised in that the distance from the upper (17) to the middle arm (18) and from the lower (17) to the middle arm (18) corresponds to a material thickness of the contact element (2), and in that the thickness of the middle arm (18) corresponds to a distance between the two partial contacts (4, 5).

10. Device for power contacting (1) according to claim 1, characterised in that the respective connection surfaces of the partial contacts (4, 5) and the electrical connection (3) comprise corresponding gratings (19).

* * * * *